United States Patent [19]

Maloney et al.

[11] 4,114,148

[45] Sep. 12, 1978

[54] DISPLAY PANEL WITH PHOSPHORS

[75] Inventors: Thomas C. Maloney, Bernardsville, N.J.; Rudolph A. Cola, Malvern, Pa.

[73] Assignee: Burroughs Corporation, Detroit, Mich.

[21] Appl. No.: 685,526

[22] Filed: May 12, 1976

[51] Int. Cl.[2] ..... H01J 17/48

[52] U.S. Cl. ..... 340/343; 313/497; 313/517; 340/336

[58] Field of Search ..... 313/496, 497, 517, 485; 340/336, 343, 378 R, 344

[56] References Cited

U.S. PATENT DOCUMENTS

| | | | |
|---|---|---|---|
| 3,675,065 | 7/1972 | Warne | 340/336 |
| 3,846,662 | 11/1974 | Hooker | 313/496 |
| 3,897,614 | 8/1975 | Armstrong | 313/496 |
| 4,041,348 | 8/1977 | Eto et al. | 313/517 X |

*Primary Examiner*—David L. Trafton

*Attorney, Agent, or Firm*—Kevin R. Peterson; Robert A. Green

[57] ABSTRACT

A display panel includes one or more character display positions, each of which comprises a cathode, an anode, and an array of anodic display elements. The display elements comprise conductive phosphor segments which can be energized in different combinations to emit light and display a character. In operation of the panel, the cathode and anode are connected in an operating circuit, and then selected phosphor segments are energized by information signals to transfer electrons thereto and to display a character.

12 Claims, 5 Drawing Figures

Fig. 3
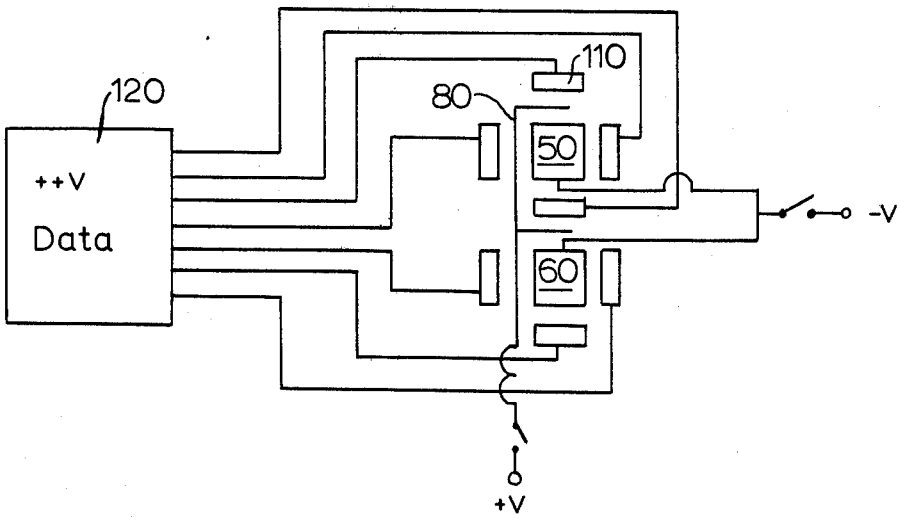
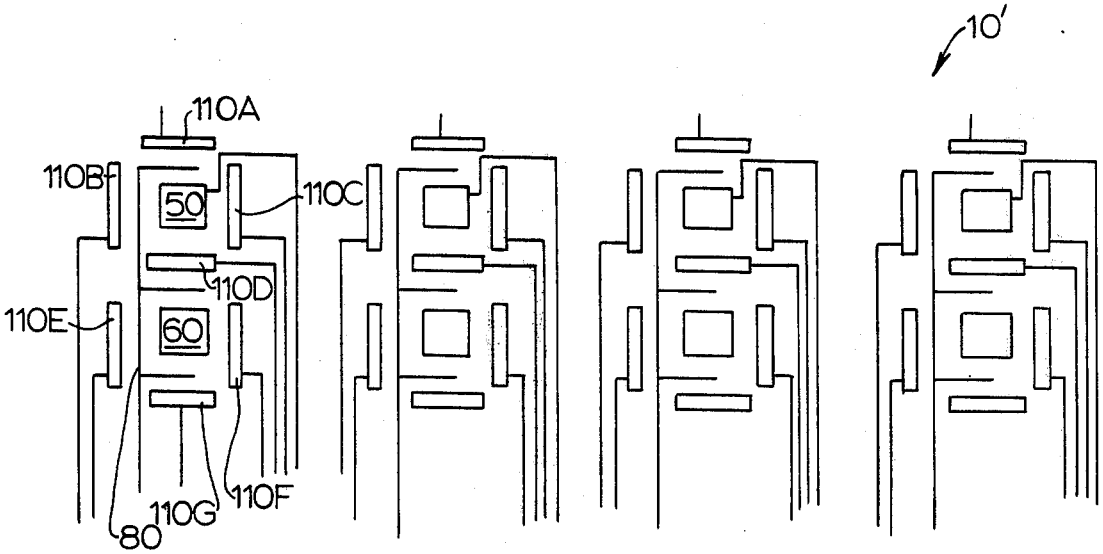
Fig. 4

DISPLAY PANEL WITH PHOSPHORS

BACKGROUND OF THE INVENTION

Flat panel display devices of various types have come into commercial use, replacing individual display devices such as NIXIE tubes. One type of panel, known as a PANAPLEX panel, made and sold by Burroughs Corporation, is a gas-filled device which normally uses a neon or neon-containing gas and generates light which is orange in color. This type of device operates well; however, it would be desirable for panels of this type to display characters in other colors. The present invention provides such a panel.

SUMMARY OF THE INVENTION

Briefly, a display panel embodying the invention includes one or more character display positions, each of which is comprised of a cathode, an anode, and an array of anodic phosphor display segments. In operation of the panel, the cathode and anode are connected in an operating circuit, and then selected phosphor display segments are energized to transfer electrons thereto and to display a character.

DESCRIPTION OF THE DRAWINGS

FIG. 3 is a schematic representation of the panel of FIG. 1 and a circuit for operating the same;

FIG. 4 is a plan view of a portion of a modification of the invention; and

DESCRIPTION OF THE PREFERRED EMBODIMENTS

Figure 1:
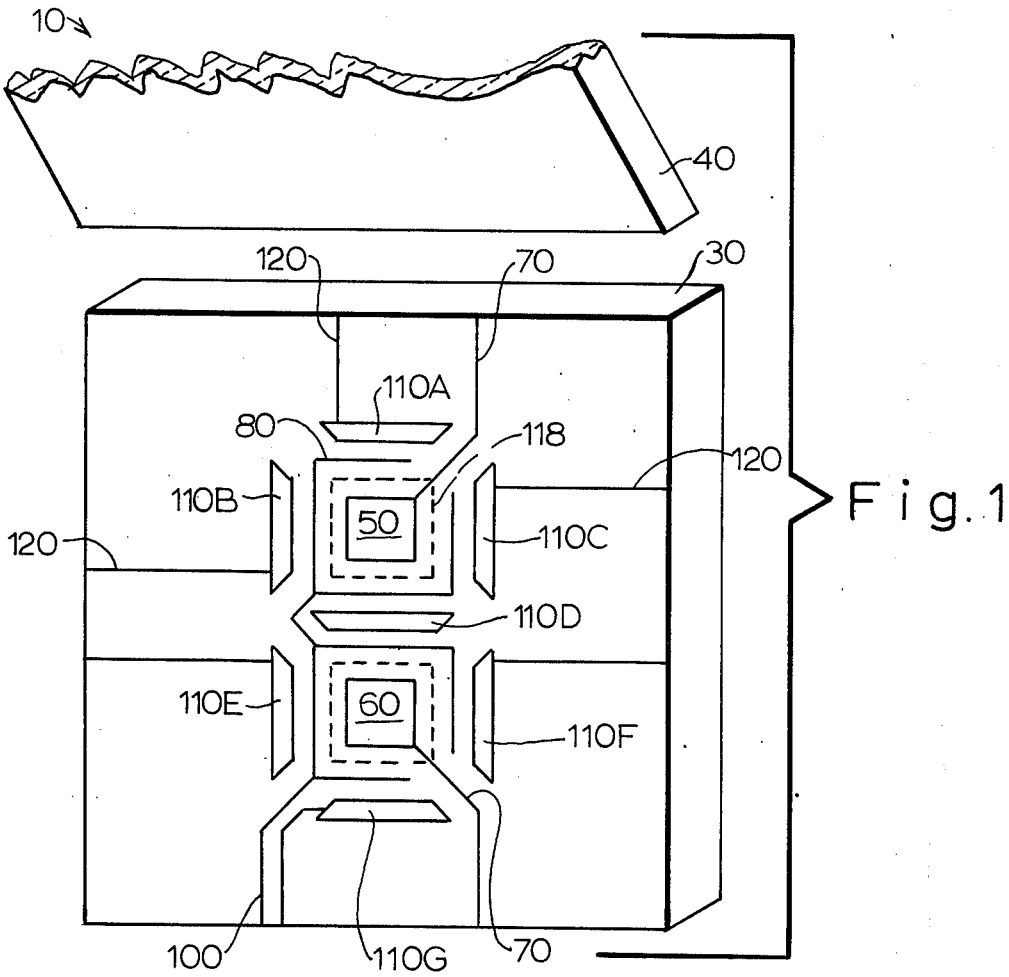
FIG. 1 is an exploded view of a display panel embodying the invention.

The principles of the invention can be used in panel display devices of many types such as those which can display numbers and letters and are used in electronic calculators, clocks, and the like.

Referring to the drawings, a display device 10 embodying the invention includes an envelope made up of a base plate 30 and a face plate 40 hermetically sealed together with a suitable spacing between them to form a chamber filled with an ionizable gas such as neon, argon, xenon, or the like, singly or in combination at a suitable pressure. The envelope includes a group of electrodes in the form of line-like segments which can be energized in different combinations to display numberals "0" to "9" or other characters, as is well known.

The group of electrodes contained within the panel is supported on the base plate and includes a first upper cathode 50 and a second lower cathode 60, the cathodes being generally rectangular in form in one embodiment of the invention. The cathodes 50 and 60 are generally vertically aligned, and each cathode includes a lead 70 which extends out of the display area formed by the electrode assembly to an edge so that external circuit connection can be made thereto. In one arrangement, the leads 70 extend from a corner of each cathode area. The electrode assembly includes a single anode 80 which is shaped to enclose, and thus be in operative relation with, the cathode areas 50 and 60. The anode is provided with a lead 100 which extends out of the display area of the electrode assembly to an edge of the panel. The cathode leads 70 extend between portions of the anode segments.

Figure 2:
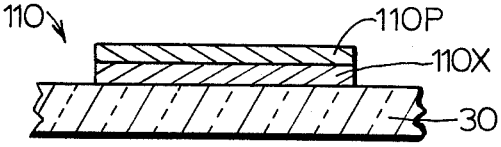
FIG. 2 is a sectional view of a portion of the panel of FIG. 1.

Finally, the electrode assembly includes display elements in the form of line-like segments 110 arrayed generally in a figure "8" pattern, as is well known in the art, with each display segment adjacent to and in operative relation with a portion of the anode 80 and the cathodes 50 and 60. The display segments 110 comprise conductive base members 110X (FIG. 2) coated with a layer 110P of a phosphor such as zinc oxide. Each of the segments 110 is provided with a lead 120, by which external electrical potentials can be connected thereto.

Means, represented by dash lines 118 (FIG. 1), are provided, for example, in the form of an opaque coating, on the inner surface of face plate 40 and overlying cathodes 50 and 60 so that these cathodes cannot be seen by a viewer when the panel is in operation.

As is well known in the art, all of the electrodes in the assembly described may be formed by a screen printing process. In addition, the conductive base member 110X of the display segments 110 may be metal strips, as well as screened members. Also, the phosphor material 110F may be deposited by settling, painting, spraying, or the like.

The gas selected for use in the panel 10 is determined by a number of factors, as is well known to those skilled in the art. Pure gases having relatively high energy electrons are preferred, since they would provide optimum energization of the phosphor. However, if the panel contained a pure gas, undesirably high potentials might be required for its operation. A suitable balance can be achieved by using mixtures of gases such as neon with a small quantity of xenon at a pressure above about 100 Torr at room temperature. This is one suitable compromise, but other gases and pressures might be more suitable under certain circumstances, as can be readily determined by those skilled in the art.

In one mode of operation of the display device 10, referring to FIG. 3, the cathodes 50 and 60 are connected to generally negative potential, either separately or as a single unit, and the anode 80 is connected to generally positive potential. With the anode and cathodes thus connected, cathode glow is generated at the cathodes, with current flow between the cathodes and anode 80. A character is displayed by input information signals, from a suitable data source 120, applied to selected display electrodes 110. These information potentials are more positive than the potential on anode 80, and, as a result, current flows preferentially between the cathodes 50 and 60 and the selected display segments 110. The resultant impingement of electrons on the phosphor layers 110P causes these layers to glow, and all of the selected glowing phosphor areas form a character. The various potentials applied may be D. C. or pulsating, as is well known in the art.

In a modification of the invention illustrated in FIG. 4, a display device or panel 10' includes a plurality of groups of electrodes, such as seen in FIG. 1, in a single envelope, each group representing a display position. Panels of this type are now widely used in calculators, clocks, and the like. The panel 10' may be operated generally as described above, or it may be operated in multiplex fashion, as illustrated schematically in FIG. 5, wherein each pair of cathodes 50 and 60 is connected to a cathode driver 140 which comprises essentially a source of suitably negative potential, and each anode 80 is connected to an anode driver 150 which represents a source of generally positive potential. The display anodes 110 are connected in groups, with the same corresponding anode connected in the same group and to the same common conductor, and each such common conductor is connected to a source of data signals 120. The sources of data signals 120 receive their signals from a computer 130 or other suitable data source. Thus, anodes 110A are connected to common conductor 114A and to data source 120A, anodes 110B are connected to conductor 114B and to data source 120B, etc.

Figure 5:
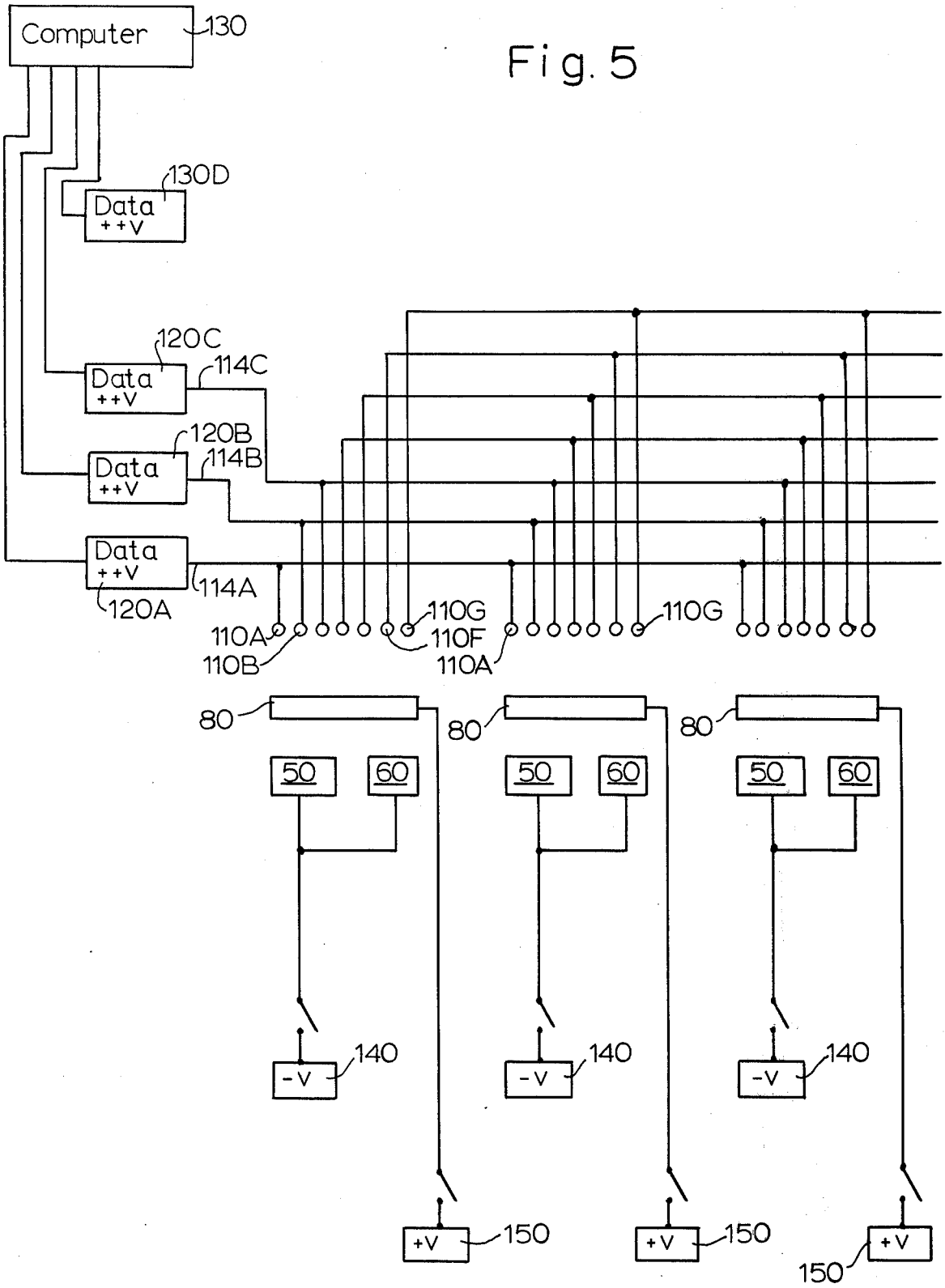
FIG. 5 is a schematic representation of the panel of FIG. 4 and a system in which it may be operated.

The apparatus of FIG. 5 is operated generally similarly to panels of the type known as PANAPLEX panels which are used in calculators. In this mode of operation, known as multiplexing, cathode glow is established in each character position of the panel in turn by the application of operating potentials to the cathodes 50, 60 and anode 80 at the position. As each position is thus energized, selected data sources 120 are energized to apply potential to the associated anodes 110 which receive current and generate glow. Each group of electrodes is thus energized in turn, sequentially and repetitively to form a generally stationary but changeable message.

It is noted that the phosphor material used in practicing the invention is preferably conductive and can be stimulated to glow by relatively low energy electrons. Zinc oxide phosphors are known to have these characteristics.

What is claimed is:

1. A display panel comprising
a gas-filled envelope,
a glow cathode in said envelope,
a first anode in operative relation with said glow cathode and positioned to form a first current flow path therewith,
means for connecting said first anode and said glow cathode in said first current flow path whereby electrical potentials can be applied therebetween to cause said cathode to exhibit cathode glow,
a second anode in operative relation with said glow cathode and positioned to form a second current flow path therewith,
means for connecting said second anode and said glow cathode in said second current flow path whereby electrical potentials can be connected therebetween and current flow can be directed preferentially between said cathode and said second anode, and
phosphor material adjacent to said second anode and generating light output when current flows between said cathode and said second anode,
said cathode, said first anode and said second anode being generally aligned along said first and second current flow paths.

2. The panel defined in claim 1 wherein said phosphor material is electrically conductive.

3. The panel defined in claim 1 wherein said phosphor material includes zinc oxide phosphor.

4. A display panel comprising
a gas-filled envelope,
a glow cathode in said envelope,
a first anode in operative relation with said glow cathode and positioned to form a first current flow path therewith,
means for connecting said first anode and said glow cathode in said first current flow path whereby electrical potentials can be applied therebetween to cause said cathode to exhibit cathode glow,
a plurality of second anodes in operative relation with said glow cathode and positioned to form separately operable second current flow paths between each second anode and said cathode, said second anodes being energizable in different combinations,
means for connecting said second anodes and said glow cathode in said second current flow paths whereby electrical potentials can be connected therebetween and current flow can be directed preferentially between said cathode and selected ones of said second anodes, and
a body of phosphor material adjacent to each said second anode and generating light output when current flows between said cathode and a second anode,
each second current flow path extending from said cathode, to said first anode and then to a second anode.

5. A display panel comprising
a gas-filled envelope,
a plurality of glow cathodes in said envelope,
first anode means in operative relation with all of said glow cathodes and positioned to form first current flow paths between said first anode means and each glow cathode,
means for connecting said first anode and said glow cathodes in said first current flow path whereby electrical potentials can be applied therebetween to cause said cathodes to exhibit cathode glow,
second anode means in operative relation with said glow cathodes and positioned to form second current flow paths between said second anode means and one of said cathodes,
means for connecting said second anode means and said glow cathodes in said second current flow path whereby electrical potentials can be connected therebetween and current flow can be directed preferentially between one of said cathodes and said second anode means, and
phosphor material adjacent to said second anode means and generating light output when current flows between said cathodes and said second anode means,
each second current flow path extending from one of said cathodes, to said first anode and then to a second anode.

6. The panel defined in claim 5 wherein said second anode means comprises a plurality of anode segments in operative relation with each said glow cathode and positioned to form separately operable second current flow paths with said cathodes, said second anode segments being energizable in different combinations.

7. The panel defined in claim 5 wherein said phosphor material is electrically conductive.

8. The panel defined in claim 5 wherein said phosphor material includes zinc oxide phosphor.

9. A display panel comprising
a gas-filled envelope,
a plurality of groups of electrodes spaced apart in said envelope, each such group including
a glow cathode,
a first anode in operative relation with said glow cathode and positioned to form a first current flow path therewith,
means for connecting said first anode and said glow cathode in said first current flow path whereby electrical potentials can be applied therebetween to cause said cathode to exhibit cathode glow, a second anode in operative relation with said glow cathode and positioned to form a second current flow path therewith,, means for connecting said second anode and said glow cathode in said second current flow path whereby electrical potentials can be applied therebetween and current flow can be directed preferentially between said cathode and said second anode, and phosphor material adjacent to said second anode and generating light output when current flows between said cathode and said second anode, said cathode, said first anode and said second anode being generally aligned along said first and second current flow paths.

10. The panel defined in claim 9 wherein said phosphor material is electrically conductive.

11. The panel defined in claim 9 wherein said phosphor material includes zinc oxide phosphor.

12. A display panel comprising a gas-filled envelope, a first array of character-representing electrodes individually energizable to emit light, a second array of electrode means, including a first portion and a second portion, and operable to generate current flow between said first portion and said second portion thereof to generate first glow discharge, said second portion of said second array being positioned adjacent to all of the electrodes of said first array, said character-representing electrodes of said first array including means for drawing current away from said second portion of said second array to selected ones of said character-representing electrodes whereby current flows between said first portion of said second array and said selected character-representing electrodes of said first array to generate second glow discharges, said selected ones of said character-representing electrodes thereby being caused to glow.

* * * * *